US009027460B2

(12) United States Patent
de Maglie et al.

(10) Patent No.: US 9,027,460 B2
(45) Date of Patent: May 12, 2015

(54) PISTON-CYLINDER UNIT WITH DEVICE FOR DETERMINING POSITION

(75) Inventors: Rodolphe de Maglie, Lindau (DE); Alfred Engler, Sigmarszell (DE); Ralf Cremer, Lindau (DE); Hans-Peter Lavergne, Trunkelsberg (DE)

(73) Assignee: Liebherr-Elektronik GmbH, Lindau (DE)

( * ) Notice: Subject to any disclaimer, the term of this patent is extended or adjusted under 35 U.S.C. 154(b) by 664 days.

(21) Appl. No.: 13/347,935

(22) Filed: Jan. 11, 2012

(65) Prior Publication Data

US 2012/0174771 A1 Jul. 12, 2012

(30) Foreign Application Priority Data

Jan. 12, 2011 (DE) ..... 10 2011 008 381

(51) Int. Cl.
*F15B 15/28* (2006.01)

(52) U.S. Cl.
CPC ..... *F15B 15/2815* (2013.01); *F15B 15/2869* (2013.01)

(58) Field of Classification Search
CPC ..... F15B 15/2815; F15B 15/2869
USPC ..... 92/5 R
See application file for complete search history.

(56) References Cited

U.S. PATENT DOCUMENTS

| | | | | |
|---|---|---|---|---|
| 4,901,628 | A * | 2/1990 | Krage | 92/5 R |
| 5,901,633 | A * | 5/1999 | Chan et al. | 92/5 R |
| 7,451,684 | B2 * | 11/2008 | Muller et al. | 92/5 R |
| 8,117,908 | B2 | 2/2012 | Engler et al. | |
| 2006/0087314 | A1 | 4/2006 | Zhu et al. | |

FOREIGN PATENT DOCUMENTS

| | | | |
|---|---|---|---|
| DE | 202008010230 | U1 | 12/2009 |
| FR | 1525363 | A | 5/1968 |

* cited by examiner

*Primary Examiner* — F. Daniel Lopez
(74) *Attorney, Agent, or Firm* — Alleman Hall McCoy Russell & Tuttle LLP

(57) ABSTRACT

The present disclosure relates to a piston-cylinder unit with a device for determining position, the device comprising at least one exciter that is indirectly or directly electrically connected with the cylinder jacket and the cylinder piston of the piston-cylinder unit, and that excites the electrical oscillating circuit formed by the piston-cylinder unit and the contact lines to oscillate at its resonant frequency, it being possible to measure an electrical signal characterizing the resonant frequency on the piston-cylinder unit. The invention also relates to a construction machine or piece of hoisting equipment with such a piston-cylinder unit.

15 Claims, 4 Drawing Sheets

PISTON-CYLINDER UNIT WITH DEVICE FOR DETERMINING POSITION

CROSS REFERENCE TO RELATED APPLICATION

This application claims priority to German Patent Application No. DE 10 2011 008 381.2, entitled "Piston-Cylinder Unit with Device for Determining Position", filed Jan. 12, 2011, which is hereby incorporated by reference in its entirety for all purposes.

TECHNICAL FIELD

This present disclosure relates to a piston-cylinder unit with a device for determining position.

BACKGROUND AND SUMMARY

Determining the position of a cylinder piston represents a necessary and important task in a series of technical applications. In particular, the exact position of the cylinder piston often plays a major role in targeted control of the piston-cylinder unit. Moreover, determining the position can decisively increase the operational reliability of a piston-cylinder unit, since the intake of the hydraulic medium, in particular the hydraulic fluid, at the extreme positions of the cylinder piston can be exactly controlled and consequently stopped at the right time.

Precise position determination is also important in the automatic control of the piston-cylinder units in construction machines and hoisting equipment. The piston-cylinder unit actuates the working devices of the construction machine or hoisting equipment in the usual manner. Sufficiently precise determination of the position of the piston-cylinder unit increases the quality of the control, and therefore is absolutely essential.

The high control pressures prevailing within the piston-cylinder unit, which occur especially in hydraulic cylinder units, often allow only slight modification of the piston or the cylinder jacket without interfering with the entire system in a way that is relevant to safety. For this reason, setting up a suitable position measuring device often turns out to be especially difficult and cost-intensive.

Numerous piston-cylinder units pick up the instantaneous position of the cylinder piston by cable potentiometers.

Processes are also known that work according to a magnetostrictive principle. These involve picking up the position of the piston using a ring magnet attached at a specific piston position in combination with a sensor built into the piston rod.

However, one thing that all known processes have in common is that they require elaborate and cost-intensive modifications of the piston-cylinder unit. Additional transducers and sensors must first be integrated into the piston-cylinder unit.

The present disclosure has the goal of pointing out a piston-cylinder unit with a device for determining position that has satisfactory stability and robustness but is nevertheless simple and economical to produce and attach.

This is accomplished by a piston-cylinder unit with a device for determining position. It is possible for the piston-cylinder unit to be made in the form of a hydraulic cylinder and for it to use a hydraulic oil as its hydraulic medium.

The device for determining position comprises at least one exciter that is electrically connected, indirectly or directly, with the cylinder jacket and with the cylinder piston of the piston-cylinder unit. In this arrangement, the cylinder jacket and cylinder piston function as the electrodes of a series-resonant circuit. The piston rod and cylinder jacket form a series inductance. Opposite surfaces of the piston and cylinder jacket form a capacitance with hydraulic media. Accordingly, the complete piston-cylinder unit can be understood as an oscillating circuit.

The exciter according to the present disclosure serves to excite the electrical series-resonant circuit to oscillate at its resonant frequency. In theory, the resonant frequency that is set up in an oscillating circuit is a function of the capacitance and inductance. Consequently, it is possible to deduce the variable capacitance of the piston-cylinder unit from the resonant frequency, the capacitance and inductance depending on the instantaneous position of the piston. Thus, it is possible to determine the exact instantaneous position of the piston from the resonant frequency. To accomplish this, it is also possible to measure an electrical signal characterizing the resonant frequency on the device according to the present disclosure.

The present disclosure utilizes the advantage that the piston-cylinder unit is suitable, without modification, to form an electrical oscillating circuit. In contrast to the prior art, it is not necessary to arrange any external sensors or transducers or additional electrodes on or inside the piston-cylinder unit. The known components of a piston-cylinder unit, such as the cylinder jacket and the cylinder piston, are used to form a series-resonant circuit. Thus, in one example, the piston-cylinder is without an external sensor or transducer or additional electrodes on or inside the piston-cylinder unit for position detection.

The exciter advantageously comprises an oscillating circuit that is electrically connected with the piston-cylinder unit. A Hartley oscillating circuit is especially advantageous.

The resonant frequency of the oscillating circuit is a high-frequency signal, known from experience to lie in the megahertz frequency band. The piston-cylinder unit can act as an antenna that emits electromagnetic waves. In this connection, it can be expedient for at least part of the device for determining position to be advantageously arranged inside of the cylinder housing or cylinder jacket. In particular, the exciter is arranged inside the piston-cylinder unit or a hollow space in the piston-cylinder unit provided for this purpose. The shielding effect of the cylinder jacket has an advantageous effect on the EMC characteristics [electromagnetic compatibility] of the device or the piston-cylinder unit.

Alternatively, it is possible that at least one additional shield to be provided that covers the externally arranged device for determining position, in particular the exciter, and prevents the emission of electromagnetic waves. It turns out to be advantageous for the shield to be magnetic, in particular made from a ferromagnetic material. Of course other shielding materials are also conceivable that are suitable to cover and shield the device for determining position. It also turns out to be advantageous to use at least one EMI filter [electromagnetic interference filter].

It is possible for the measured signal characterizing the resonant frequency to be an electrical voltage. This voltage has an oscillating signal shape during the oscillation of the piston-cylinder unit; it is advantageously electrically insulated, and is used as a square wave signal for digital evaluation.

Under some circumstances, the oscillating circuit components or external influences are damped and interfere with the oscillation behavior. To keep the oscillation amplitude constant, it can be advantageous for there to be a circuit device to stabilize the measurable voltage. External influences include, for example, moisture, dust deposits, etc. This measure stabilizes the resonant frequency and makes it possible to determine the position with sufficient accuracy.

It is possible to provide an evaluation device that is suitable to evaluate the signal and output the current piston position. The evaluation device can be an appropriately configured microcontroller or a suitable analog circuit device having computer readable storage media and code therein to carry out the various actions described herein. The evaluation device is either solidly or detachably connected with the piston-cylinder unit.

To reduce the resonant frequency, it can be advantageous to arrange an additional inductance between the exciter and the piston or between the exciter and the cylinder jacket. This can be advantageous for technical reasons involving EMC.

It is advantageous for the contact between the exciter and the piston-cylinder unit to be a sliding contact. The contact between the moving part of the piston-cylinder unit, in particular the piston rod, may be made by a sliding contact. It has turned out to be expedient for the contact between the piston rod and the exciter to be a brush type of contact, the brush sliding along the surface of the piston rod as the piston moves. it is possible for the brush to consist of carbon, bronze, or another suitable material.

Alternatively, the contact between the piston rod and the exciter can be made by a capacitive or conducting ring. The ring is arranged so that it can slide coaxially on the surface of the piston rod. Using a capacitive ring creates an additional constant capacitance, which is connected in series with the oscillating circuit.

It is possible for the ring to consist of a conductive material that is indirectly or directly connected with the exciter, a dielectric being arranged between the ring and the piston rod, or the conductive ring being directly electrically connected with the piston rod. It is also possible to isolate the piston-cylinder unit from the oscillator or the exciter by inserting a transformer. The leakage inductance of the transformer can also be used to reduce the resonant frequency.

Moreover, the present disclosure relates to a construction machine or a piece of hoisting equipment with a piston-cylinder unit described in one of the preceding advantageous embodiments. The construction machine or a piece of hoisting equipment according to the present disclosure has the same advantages and properties as the piston-cylinder unit described above, for which reason it is not explained again here.

The use of the piston-cylinder unit is not in any way limited to construction machines or hoisting equipment. Possible areas of application are found in aircraft or generally in all machines/equipment with hydraulic/pneumatic technology.

Further advantages and details of the present disclosure will be explained detail below using the sample embodiments shown in the drawings.

DETAILED DESCRIPTION

Figure 1:
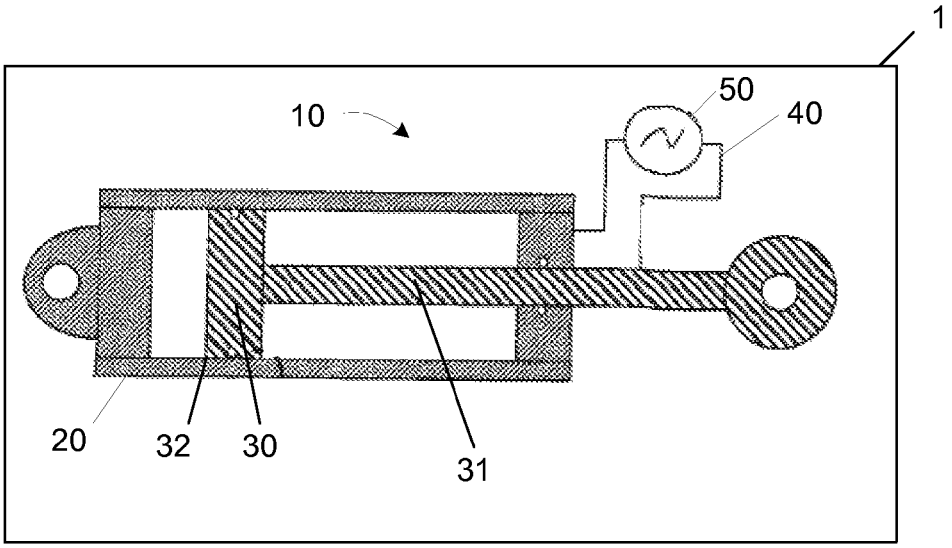
FIG. 1 shows the piston-cylinder unit according to the present disclosure with a device for determining position.

FIG. 1 shows the piston-cylinder unit 10 according to the present disclosure with a device for determining position. The piston-cylinder unit 10 may be included in a machine or equipment 1, such as a construction machine or a piece of hoisting equipment. The body of piston-cylinder unit 10 resembles a known piston-cylinder unit. In particular, unit 10 comprises a tubular cylinder jacket 20, whose hollow space holds a piston 30 with attached piston rod 31 that can move in a line.

Piston-cylinder unit 10 may be used in construction machines or hoisting equipment 1, wherein piston-cylinder unit 10 drives an attached working device. The automatic operation of the working device requires precise determination of the position of piston 30.

Making it possible to determine the exact position does not require the installation of additional sensors, electrodes, or transducers on or in piston-cylinder unit 10. Instead, the fact that appropriate excitation causes the entire piston-cylinder unit 10 to act as an electrical oscillating circuit is used to advantage. In particular, piston 30 forms the first electrode of a series-resonant circuit and cylinder jacket 20 forms its second electrode. Neither piston 30 nor piston rod 31 have a conductive connection with cylinder jacket 20; instead they are mounted so that they can slide over seals between piston 30 and cylinder jacket 20 and in the opening area of cylinder jacket 20 and protruding piston rod 31. A hydraulic cylinder has, between piston 30 and cylinder jacket 20, a hydraulic medium 32, in particular hydraulic oil, that acts as an dielectric between the two electrodes.

The oscillating circuit is excited by an exciter such as oscillator 50 that is connected through electrical lines 40 first with cylinder jacket 20 and also with piston rod 31. Oscillator 50 is structured to generate electrical excitation to excite the electrical oscillating circuit formed by the piston-cylinder unit and contact lines to oscillate at its resonant frequency. For example, oscillator 50 may be structured to generate an electrical excitation signal characterizing the resonant frequency of the piston-cylinder unit.

After the oscillating circuit is excited through oscillator 50, it oscillates at its resonant frequency. The impedance formed from piston 30 and cylinder jacket 20 depends on the respective position of piston 30 in the hollow space of the cylinder. Since the capacitance and inductance of the oscillating circuit affect the resonant frequency that is set up, it is possible to deduce the impedance of piston-cylinder unit 10 from the resonant frequency that is picked up.

To accomplish this, a corresponding output voltage $V_{out}$ is measured in the area of oscillator 50 and analyzed or interpreted by a corresponding evaluation device 11, and possibly indicated visually or acoustically by output device 12. For example, output device 12 may be a speaker or display device connected to or included within evaluation device 11 such that evaluation device 11 may output or display the piston position on output device 12. The evaluation device 11 may be in the form of an appropriately configured controller or a suitable analog circuit device having computer readable storage media and code stored thereon to carry out the various actions described herein. Exemplary actions carried out by the evaluation device 11 are further described with reference to FIG. 9 below. The evaluation device 11 is either solidly or detachably connected with the piston-cylinder unit.

The electrical contact between oscillator 50 and moving piston rod 31 is made using a sliding contact. To accomplish this, the end of lead 40 of oscillator 50 that goes to piston rod 31 has a brush contact, which slides on the surface of piston rod 31. The brushes of this point of contact may be made of carbon, bronze, or another suitable material.

Figure 2:
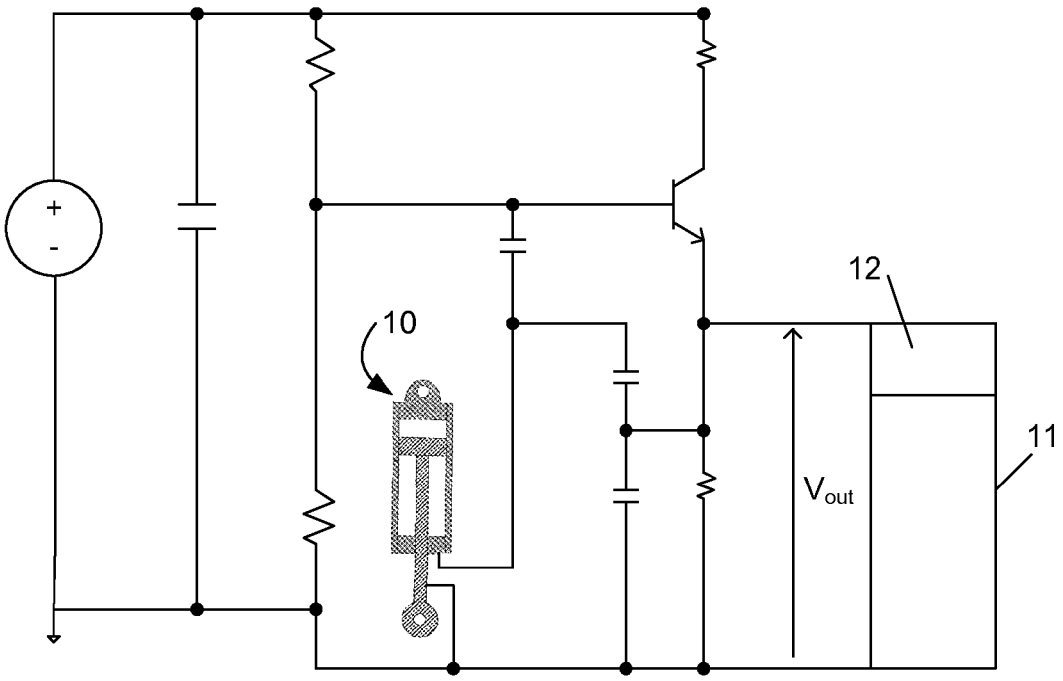
FIG. 2 shows a circuit diagram of the device according to the present disclosure for determining position.

FIG. 2 shows a circuit diagram of the piston-cylinder unit 10 according to the present disclosure with the corresponding device for determining position connected. The output voltage labeled $V_{out}$ has an oscillating signal shape describing the current resonant frequency of the entire oscillating circuit. This voltage or voltage curve changes as a function of the corresponding piston position of piston-cylinder unit 10.

Figure 3:
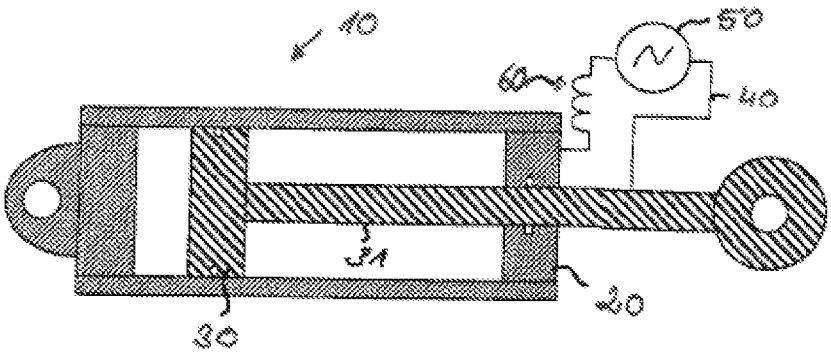
FIG. 3 shows an advantageous further development of the piston-cylinder unit according to the present disclosure.

FIG. 3 shows the piston-cylinder unit 10 according to the present disclosure known from FIG. 1, with an inductance added between oscillator 50 and cylinder jacket 20. Since the oscillating circuit formed oscillates in a high-frequency region, the inductance 60 that is also connected in series can substantially reduce the resonant frequency.

Figure 4:
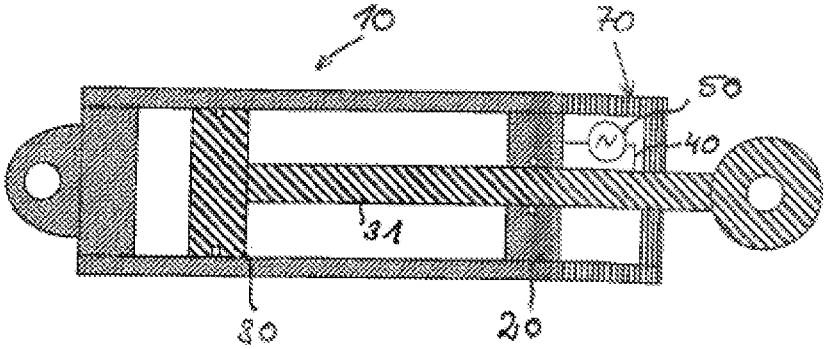
FIG. 4 shows the piston-cylinder unit according to the present disclosure with an additional shield.

Under some circumstances, the use of piston-cylinder unit 10 in construction machines or hoisting equipment 1 must satisfy high EMC requirements. As was already mentioned above, the arrangement according to the present disclosure produces especially high-frequency oscillations, which under some circumstances can extend into the megahertz frequency band. To meet the necessary EMC requirements, additional shielding 70 is installed, as shown in FIG. 4, covering the area around oscillator 50 and shielding the electromagnetic waves released into the environment because of the radiation pattern of piston-cylinder unit 10. Such shielding 70 is made out of a ferromagnetic material, for example. Of course all materials that ensure sufficient shielding of the electromagnetic waves are conceivable.

Figure 5:
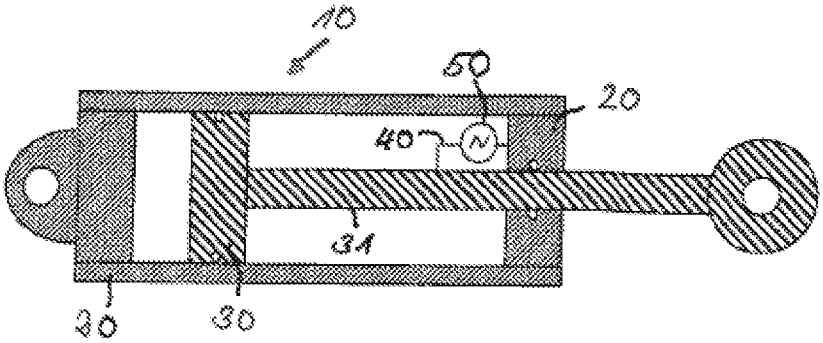
FIG. 5 shows an alternative embodiment of the piston-cylinder unit according to the present disclosure.

In an advantageous embodiment, cylinder jacket 20 can be repurposed as a shield. As is shown in FIG. 5, oscillator 50 is installed in the hollow space in cylinder jacket 20. Furthermore, radio interference suppression filters can be connected to the outputs of oscillator 50.

Figure 6:
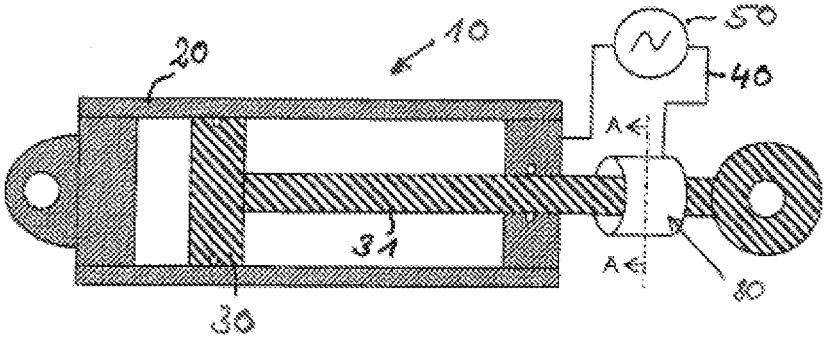
FIG. 6 shows the piston-cylinder unit according to the present disclosure with a capacitive ring arranged on it

An alternative to the embodiment of the piston-cylinder unit with sliding contacts is to implement the connection between oscillator 50 and piston rod 31 using a capacitive or conducting ring 80. As shown in FIG. 6, such a ring 80 runs coaxial to piston rod 31 and slides on its surface.

Figure 7:
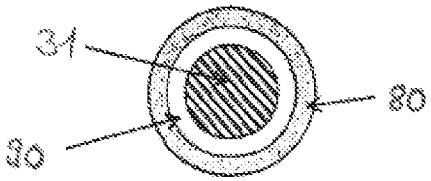
FIG. 7 shows a sectional illustration of the capacitive ring or the piston rod along the cutting line A-A.

A sectional illustration along cutting line A-A is shown in FIG. 7. This figure shows capacitive ring 80, which is made out of a conductive material. Piston rod 31 and capacitive ring 80 have a dielectric 90 between them. Ring 80 and piston rod 31 form a constant capacitance that is connected in series to the oscillating circuit.

Figure 8:
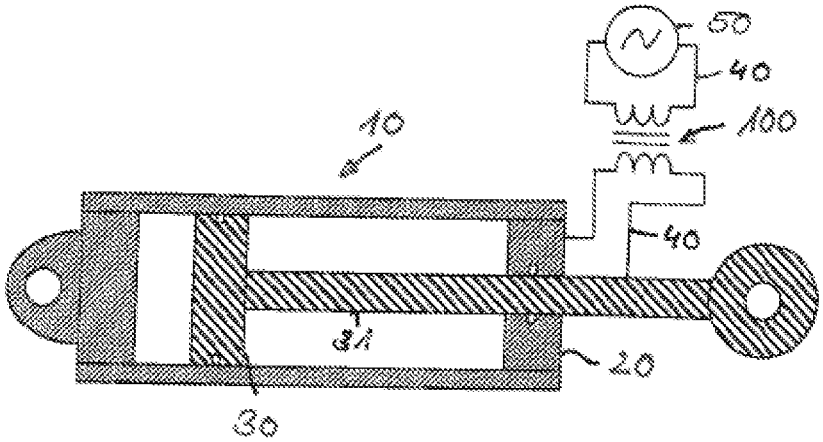
FIG. 8 shows another advantageous embodiment of the piston-cylinder unit according to the present disclosure.

FIG. 8 shows a possible decoupling of oscillator 50 from piston-cylinder unit 10. The electrical connection is made through a transformer 100. The internal inductance of the transformer 100 acts as an additional series inductance in the oscillating circuit, further reducing the resonant frequency that is set up. Transformer 100 also provides electrical insulation between the cylinder and oscillator 50.

Figure 9:
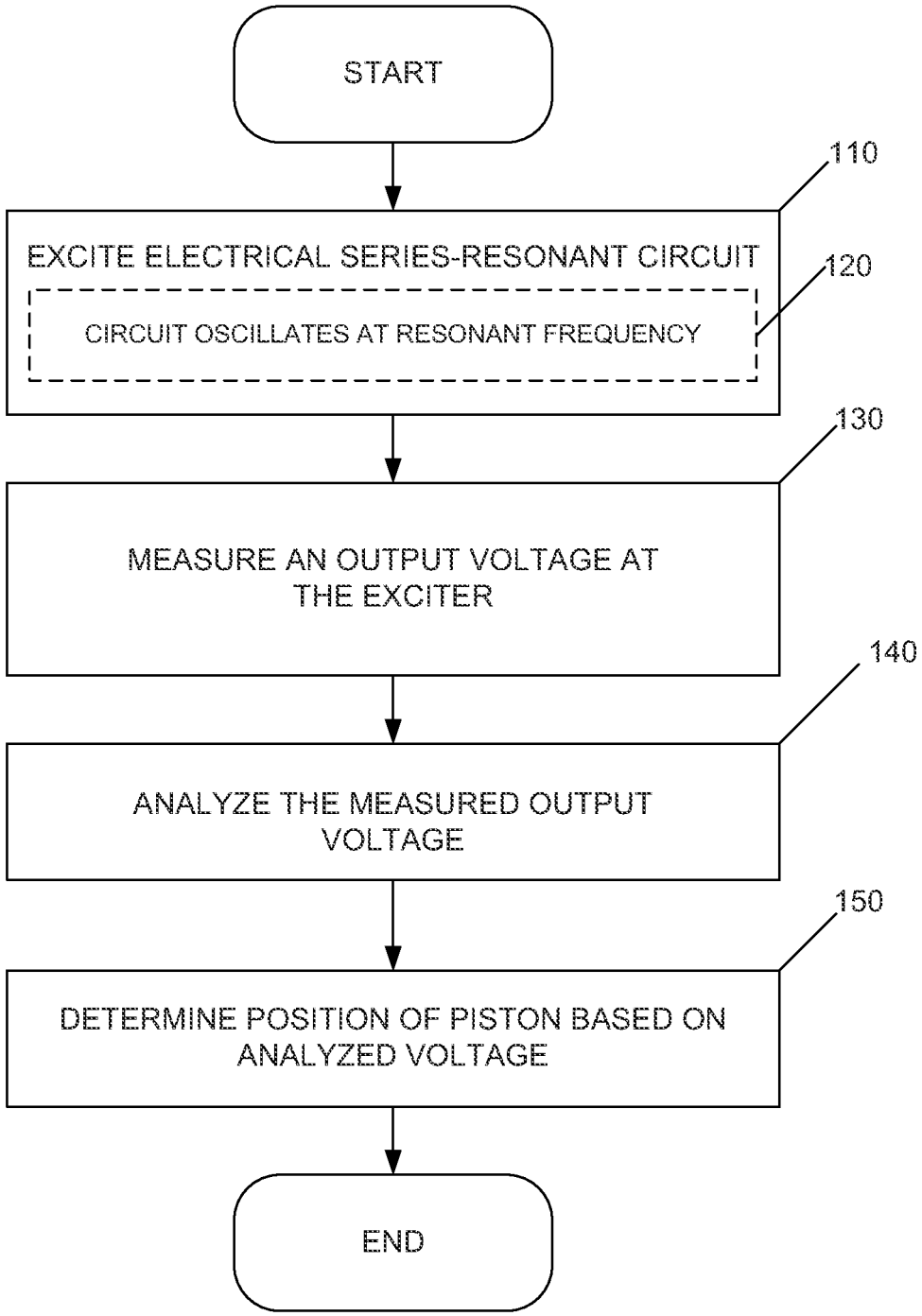
FIG. 9 shows an exemplary method of determining the position of the piston of the piston-cylinder unit according to the present disclosure.

FIG. 9 shows an exemplary method of determining an instantaneous position of the piston 30 of piston-cylinder unit 10. The method begins at step 110, when the exciter, such as oscillator 50, excites the electrical series-resonant circuit, causing it to resonate at its resonant frequency at step 120. The output voltage at the exciter 50 is measured, for example with an evaluation device 11, at step 130. This voltage is then analyzed by the evaluation device 11 at step 140, as discussed above with reference to FIG. 2, as the voltage describes the current resonant frequency of the entire oscillating circuit. The voltage or voltage curve changes as a function of the corresponding piston position of piston-cylinder unit 10. Therefore, at step 150, the instantaneous position of the piston may be determined based on the measured voltage.

The invention claimed is:

1. A piston-cylinder unit with a device for determining position, the device comprising at least one exciter that is directly electrically connected with a cylinder jacket and a cylinder piston of the piston-cylinder unit, and that excites an electrical oscillating circuit formed by the piston-cylinder unit and contact lines to oscillate at its resonant frequency.

2. The piston-cylinder unit described in claim 1, wherein the exciter is an oscillator.

3. The piston-cylinder unit described in claim 2, wherein the oscillator is a Hartley oscillator.

4. The piston-cylinder unit described in claim 1, wherein the device for determining position is arranged at least partly inside the cylinder jacket.

5. The piston-cylinder unit described in claim 1, wherein the device further comprises an evaluation device which measures and evaluates an electrical signal characterizing the resonant frequency of the piston-cylinder unit.

6. The piston-cylinder unit described in claim 1, wherein the measured electrical signal comprises a voltage.

7. The piston-cylinder unit described in claim 6, further comprising an output device which outputs or displays the piston position.

8. The piston-cylinder unit described in claim 1, further comprising at least one shield to shield the device.

9. The piston-cylinder unit described in claim 1, wherein the device is structured to generate an electrical signal characterizing the resonant frequency of the piston-cylinder unit.

10. A construction machine or piece of hoisting equipment with a piston-cylinder unit including a device for determining position, the device including at least one exciter that is directly electrically connected with a cylinder jacket and a cylinder piston of the piston-cylinder unit, and that excites an electrical oscillating circuit formed by the piston-cylinder unit and contact lines to oscillate at its resonant frequency.

11. A piston-cylinder unit comprising:

a cylinder jacket with a tubular shape that forms a hollow space therein;

a piston attached to a piston rod, housed within the hollow space of the cylinder jacket and separated from the cylinder jacket by a hydraulic medium;

an exciter electrically connected to the cylinder jacket and the piston rod, forming a series-resonant circuit in which the piston rod and cylinder jacket form a series inductance; and an evaluation device connected to the series-resonant circuit, the evaluation device comprising a controller having a computer readable medium with instructions stored thereon which, when executed, cause the evaluation device to determine a resonant frequency of the series-resonant circuit and determine a position of the piston based on the resonant frequency.

12. The piston-cylinder unit described in claim 11, further comprising at least one additional inductance arranged between the exciter and the piston or between the exciter and the cylinder jacket.

13. The piston-cylinder unit described in claim 11, wherein the exciter is indirectly electrically connected with the cylinder jacket and the piston.

14. The piston-cylinder unit described in claim 11, wherein the exciter is directly electrically connected with the cylinder jacket and the piston.

15. The piston-cylinder unit described in claim 8, wherein the at least one shield is made of ferromagnetic material.

* * * * *